US006105187A

United States Patent [19]

Gnjatovic

[11] Patent Number: 6,105,187

[45] Date of Patent: Aug. 22, 2000

[54] BEDS

[76] Inventor: Ljubomir Gnjatovic, 5 Howards Thicket, Gerrards Cross, Buckinghamshire SL9 7MT, United Kingdom

[21] Appl. No.: 09/194,280

[22] PCT Filed: May 23, 1997

[86] PCT No.: PCT/GB97/01429

§ 371 Date: Nov. 26, 1998

§ 102(e) Date: Nov. 23, 1998

[87] PCT Pub. No.: WO97/45040

PCT Pub. Date: Dec. 4, 1997

[30] Foreign Application Priority Data

May 24, 1996 [GB] United Kingdom ..... 9610900

[51] Int. Cl.[7] ..... A47C 20/08

[52] U.S. Cl. ..... 5/618; 5/616; 5/617

[58] Field of Search ..... 5/618, 617, 731, 5/733, 616; 128/845

[56] References Cited

U.S. PATENT DOCUMENTS

| | | | |
|---|---|---|---|
| 4,890,235 | 12/1989 | Reger et al. | 364/468 |
| 5,081,447 | 1/1992 | Echols | 340/573 |
| 5,642,302 | 6/1997 | Dumont et al. | 364/579 |
| 5,823,192 | 10/1998 | Kalend et al. | 128/845 |

FOREIGN PATENT DOCUMENTS

| | | |
|---|---|---|
| 0 489 310 A1 | 6/1992 | European Pat. Off. . |
| 2 693 640 | 1/1994 | France . |
| 39 04 848 A1 | 8/1989 | Germany . |
| 94/02054 | 2/1994 | WIPO . |
| 95/24848 | 9/1995 | WIPO . |
| 96/24276 | 8/1996 | WIPO . |

*Primary Examiner*—Terry Lee Melius
*Assistant Examiner*—Fredrick Conley
*Attorney, Agent, or Firm*—Davis and Bujold

[57] ABSTRACT

Motorized adjustment of the configuration of a bed in its support of a user in an automatic "sleep" mode is controlled to establish the bed in state A (FIG. 3) pre-selected for sleeping on the side, or state B (FIG. 2) pre-selected for sleeping on the back, in dependence upon whether the user's shoulder as sensed by a pressure pad (26) is within a recess (27) of the mattress (1). A motor unit (8) adjusts the bed-configuration by inclining bed-base sections (4,5) under commands from a controller (15 FIG. 4) that for the "sleep" mode operates in conjunction with an auxiliary unit (16 FIG. 4) coupled to the pad (26). Delays for changeovers between states A and B and the changeover threshold are set by controls (31, 33 and 34) of the auxiliary unit (16).

18 Claims, 3 Drawing Sheets

26
12
14
11
9
16
31
33
13
32
34
8
17
35
15
18
19
20
21
22
23
24
25
10

BEDS

The invention is particularly concerned with beds of a kind having an adjustable configuration in the support of a person using the bed, and methods of motorized adjustment of such bed-configuration. Although motorized adjustment of bed-configuration is known from FR-A-2693640, the known bed and method requires the user to initiate the adjustment made. The result is that the user must select a bed-configuration for sleep that is comfortable and otherwise appropriate to whatever body orientations he/she might adopt during sleep. Unless sleep is to be interrupted, the configuration chosen is to be comfortable throughout the period of sleep whether the user is at any time sleeping, for example, on his/her side or back.

It is an object of the present invention to provide a bed end method by which the necessity for interrupting sleep to achieve optimum comfort can be avoided.

According to one aspect of the present invention there is provided a bed having an adjustable configuration in its support of a person using the bed, in which sensing means responds to the user's body on the bed, and motor means adjusts the bed-configuration in dependence upon the response of the sensing means, characterised in that the sensing means responds to a condition that is dependent on the orientation of the user's body on the bed, and that the motor means adjusts the bed-configuration from one to another of predetermined configuration-states in dependence upon the response of the sensing means.

According to another aspect of the present invention there is provided a method of motorized adjustment of the configuration of a bed in its support of a person using the bed, in which the user's body on the bed is sensed by sensing means and motorized adjustment of the bed-configuration is effected in dependence upon the response of the sensing means, characterised in that the sensing means senses a condition that is dependent on the orientation of the user's body on the bed, and that the motorized adjustment of the bed-configuration is from one to another of predetermined configuration-states appropriate to support of the user's body in respective orientations on the bed, in dependence upon the response of the sensing means.

With the bed and method of the present invention the difficulty of making a choice of a bed-configuration :for comfort throughout the period of sleep can be significantly reduced in that the bed-configuration is adjusted automatically in dependence upon the body-orientation adopted. Thus, with the invention it is possible to arrange that the configuration of the bed adjusts appropriately to the orientation in which the user is at any time sleeping so as to afford the sleeper optimum comfort throughout. More particularly, the user may pre-select the configuration-states that are to be effective for his/her respective body-orientations.

The bed according to the invention may include controlling means that comprises memory means for storing data defining the predetermined configuration-states and means for operating the motor means in accordance with the stored data to adjust the bed-configuration to one of the defined states, the particular one of the states to which the bed-configuration is adjusted in this respect being dependent upon the response of the sensing means. The controlling means may operate said motor means to vary the bed-configuration in accordance with selective actuation of a control device by the user, such control device may also be selectively actuable by the user to enter data dependent on a selected bed-configuration into the memory means to establish that bed-configuration as one of said predetermined configuration-states.

The sensing means may comprise a load sensor for providing an output that varies in dependence upon change in load imposed upon a predetermined location of the bed, as between said respective orientations of the user's body. Where the bed has a mattress that involves a recess for receiving a shoulder of the user, the load sensor may be located within the recess for responding to the condition in which the user is lying on either side with a shoulder in the recess.

Operation of the motor means to adjust the bed-configuration in response to a predetermined change in orientation of the user's body on the bed, may be effected only if that change persists for a predetermined interval of time. This is useful for avoiding unnecessary or premature adjustments of the bed configuration.

A bed and a method of motorized adjustment of it, in accordance with the present invention, will now be described, by way of example, with reference to the accompanying drawings, in which.

Figure 1:
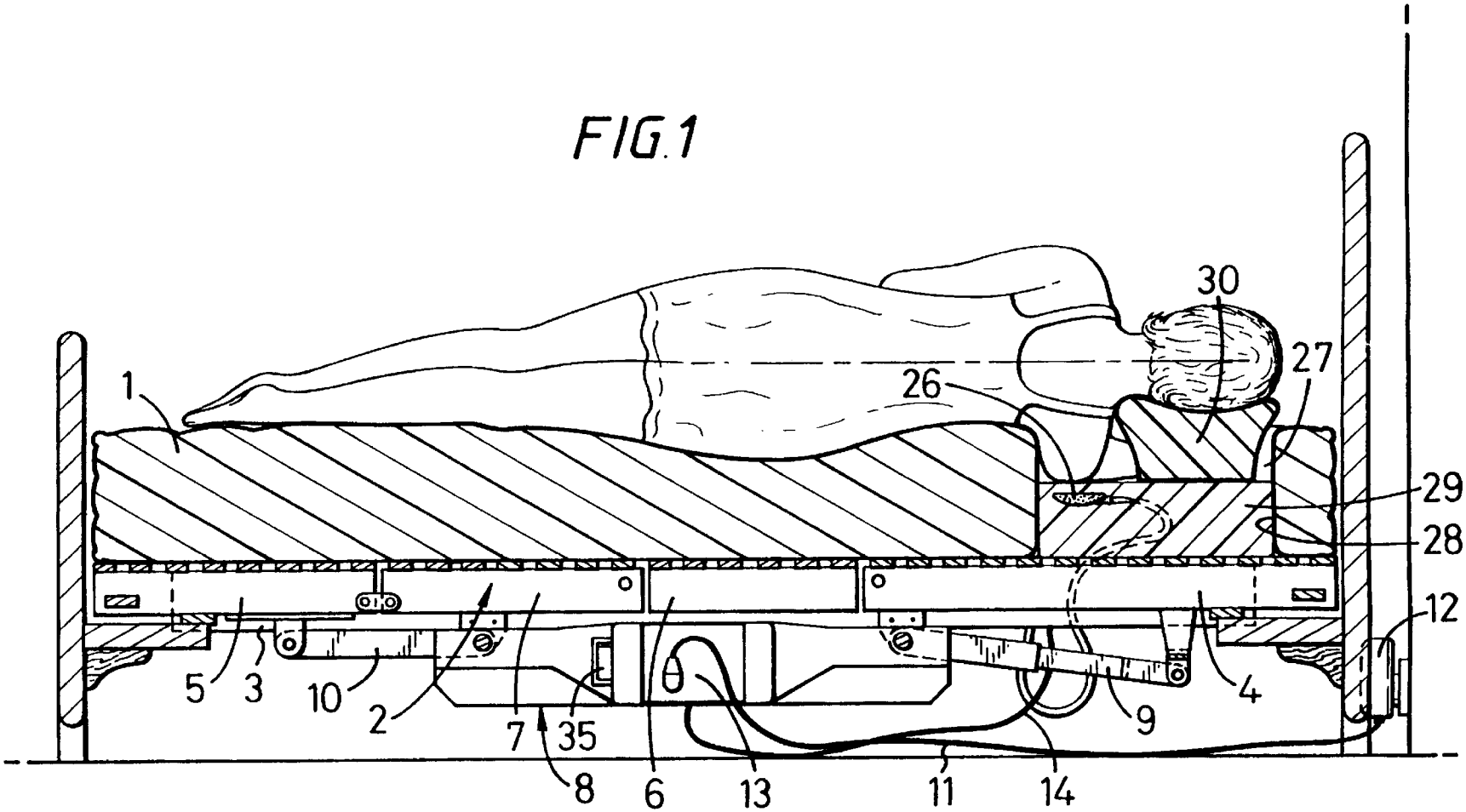
FIG. 1 is a sectional elevation of the bed according to the invention, when in use.
Figure 2:
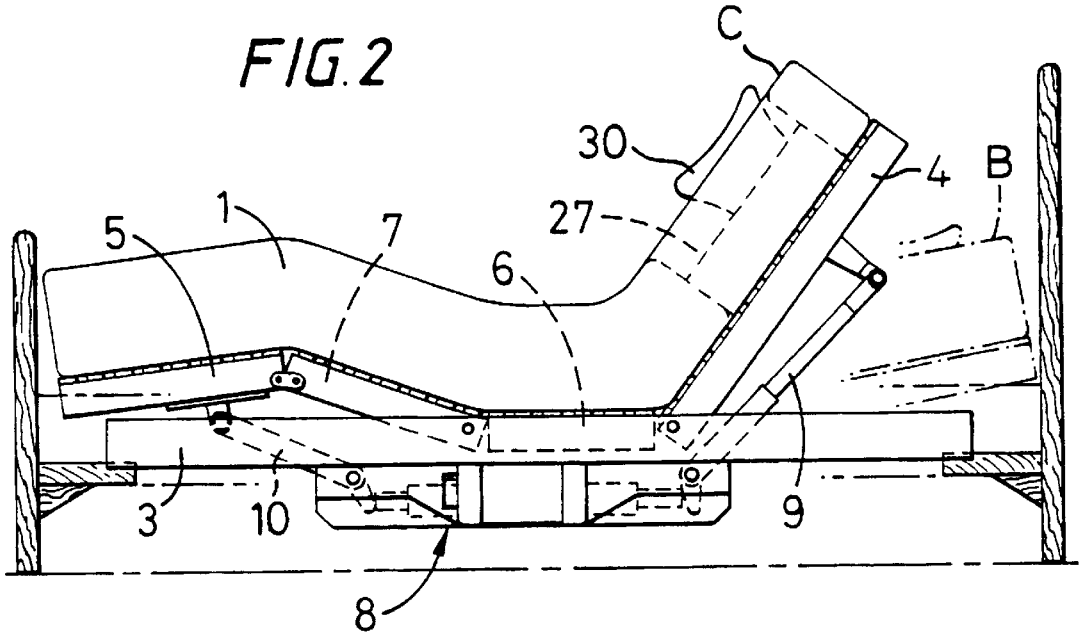
FIGS. 2 and 3 show the bed of FIG. 1 adjusted to configurations for supporting the user when reclining and when sleeping on one side, respectively.
Figure 3:
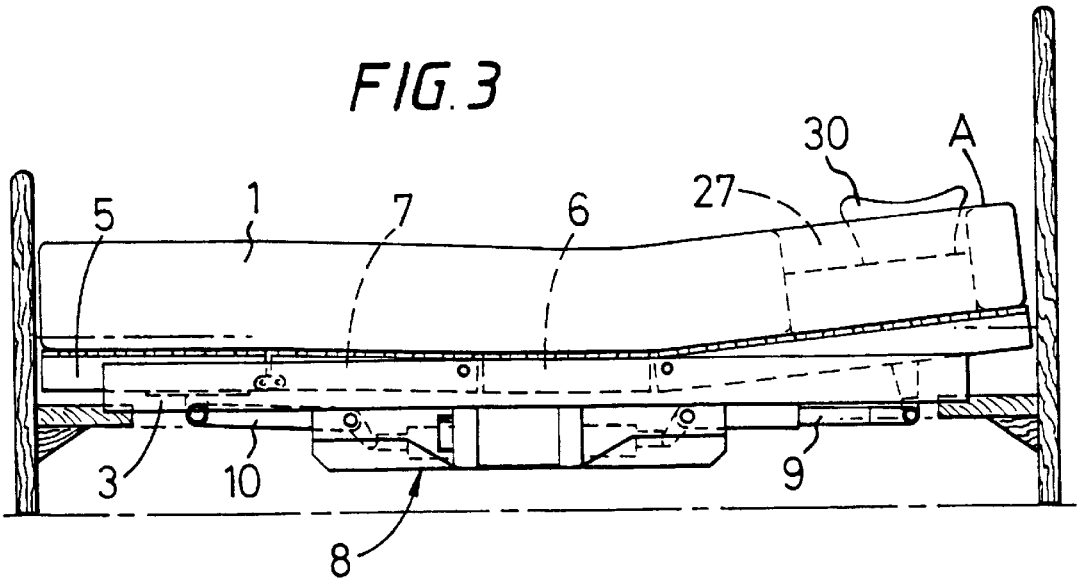

Referring to FIG. 1, the bed has a mattress 1 that is supported on a slatted base 2 within a rectangular frame 3. The base 2 consists of four interlinked sections, namely, an upper or head section 4, a lower or foot section 5 and two intermediate sections 6 and 7 that are linked to one another and to the sections 4 and 5 respectively. The section 6 is fixed to the frame 3 and the linking of the sections 4 and 7 to it, and of the section 5 to the section 7, allows for adjustment of the configuration of the bed from the level support-state shown in FIG. 1, to other states appropriate to the needs and comfort of the user of the bed. For example, the configuration of the bed may be adjusted from the level state shown in FIG. 1 to the state shown in FIG. 2 to provide support for the user in a sitting, reclined attitude, or to the state shown in FIG. 3 for sleep on the side as an alternative to the level state of FIG. 1.

Adjustment to the configuration of the bed is carried out by means of motor drive to the head and foot sections 4 and 5 to incline them relative to the frame 3. The drive is from a motor unit 8 mounted beneath the frame 3, the head and foot sections 4 and 5 being coupled to individual electric motors (not shown) of the unit 8 via pivoting arms 9 and 10 respectively. The motor unit 8, which is powered via an electric cable 11 from a supply unit 12 plugged into the electrical mains supply, includes a control unit 13 for energizing the motors in accordance with command signals supplied to it via a cable 14. The command signals are derived in accordance with selections made by the user of the bed, as will now be described with reference to FIG. 4.

Figure 4:
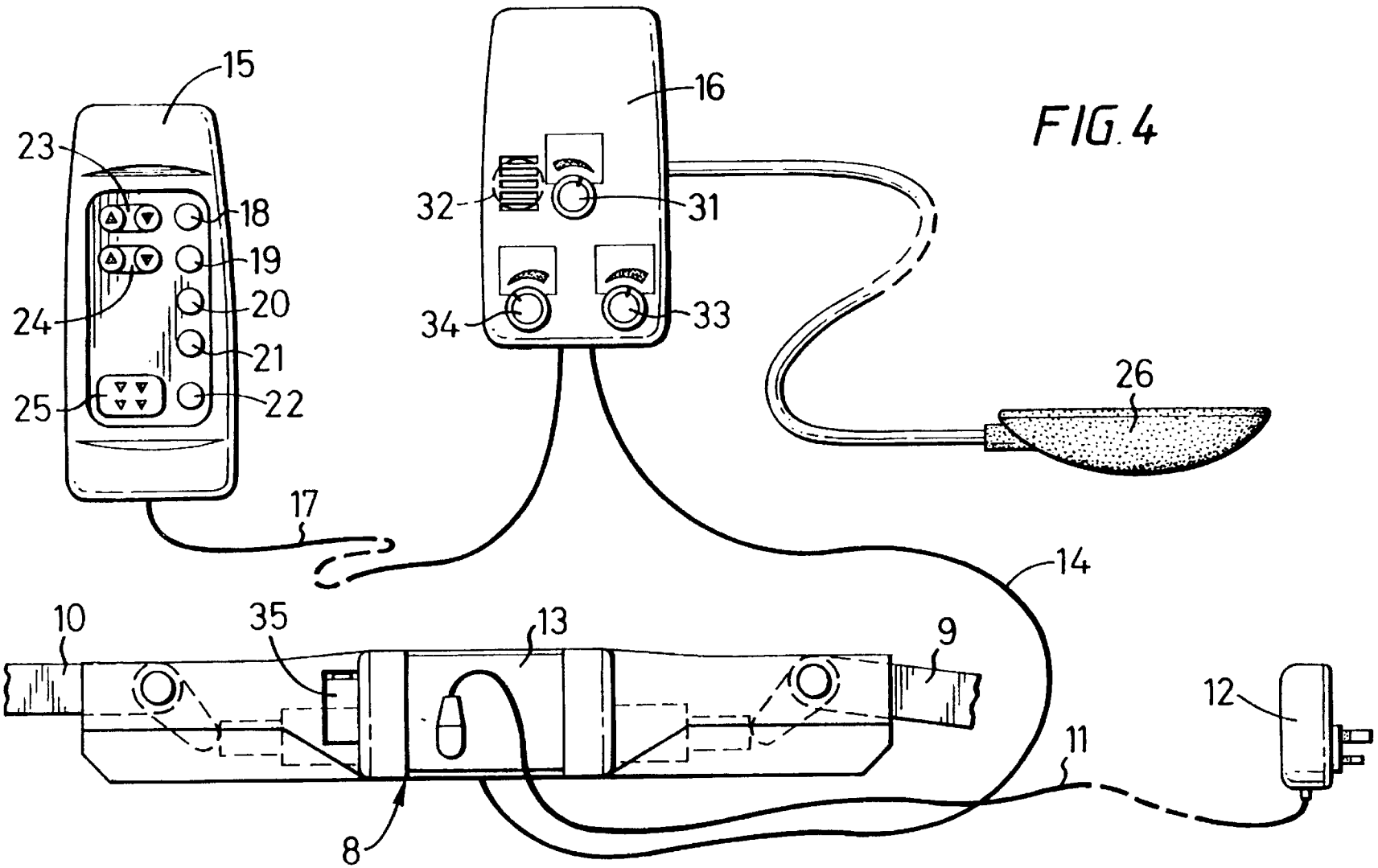
FIG. 4 shows facilities for control of the bed of FIG. 1 in performing of the method of the invention.

Referring to FIG. 4, the command signals received by the unit 13 are derived principally within a hand-controller 15 and are supplied to the cable 14 from an auxiliary unit 16 that is coupled to the controller 15 by a cable 17 (ultrasonic, infra-red or other coupling may be used instead of cable 17). The controller 15 has five push-buttons 18 to 22 together with a pair of up-down buttons 23 adjacent the button 18 and a pair of up-down buttons 24 adjacent the button 19. The pairs of buttons 23 and 24 are for commanding up and down adjustments of the head and foot sections 4 and 5 respectively, the adjusting movement being maintained in the appropriate direction, up or down, in each case only so long as the relevant button is held depressed. The facility for commanding movement of both sections 4 and 5 down together for returning the bed from any configuration to its level state (FIG. 1), is embodied in a further, larger button 25 of the controller 15.

The push-buttons 18 to 22 of the controller 15 are related to operation of the bed to adopt pre-selected configurations. In this regard, the controller 15 includes a memory (not shown) that stores data relating to three pre-selected configurations, namely: one which is associated with the button 19 and which, corresponding to the configuration-state designated A in FIG. 3, has been pre-selected by the user for sleep on his/her side; another which is associated with the button 18 and which, corresponding to the configuration-state designated B shown in chain-dotted outline in FIG. 2, has been pre-selected by the user for sleep on his/her back; and a third which is associated with the button 20 and which, corresponding to the configuration-state designated C shown in full line in FIG. 2, has been pre-selected by the user for sitting up. Adjustment of the bed directly to any one of these three pre-set configuration-states A to C can be achieved by the user, simply by depressing the relevant button 18 to 20.

The three configurations are each pre-selected with the aid of the button 22. In this regard, the bed is first adjusted for each pre-selection process to a desired configuration using the up-down buttons 23 and 24, the button 22 is then depressed followed immediately by depression of whichever button 18 to 20 is to be used to select that configuration. The configuration of the bed when the button 22 is depressed is established as the configuration pre-selected for the depressed button 18 to 20, data defining it being stored in the memory related to that particular button 18 to 20. Subsequent depression of the button 18 to 20 causes this data to be read out and translated into commands to the motor unit 8 for driving the bed to reproduce the configuration-state defined in the pre-selection process.

The button 21 of the hand-controller 15 is used to initiate an automatic "sleep" mode in which the configuration of the bed is adjusted automatically according to the orientation of the user. More particularly, the bed-configuration is adjusted between the too "sleep" configuration-states A and B that are for the time being associated respectively with the buttons 19 and 18, namely those for sleep on the back and sleep on the side. As the user's body moves from one sleep orientation to the other, so the configuration of the bed change as to ensure optimum comfort throughout. Sensing of the changes in orientation of the user's body is achieved within the auxiliary unit 16 using a load sensor in the form of an air-pressure pad 26 that is coupled to the unit 16 and responds to the condition in which the user lies on his/her side on the mattress 1.

The mattress 1 is of an advantageous construction for ensuring comfort when sleeping on the side, and in this respect features a recess 27 for receiving the arm and shoulder on which the sleeper rests in that orientation; the use of the recess 27 in this way is effective to ensure that the sleeper's spine (as evident from FIG. 1) is not unnaturally bent and the shoulder is not unduly loaded, and this applies generally even when the head section 4 of the base 2 is inclined slightly as with configuration-state A. The recess 27 is defined by the upper part of an aperture 28 through the mattress 1, and a block 29 (having an internal construction comparable with that of the mattress 1) that occupies the lower part of the aperture 28. The block 29, which has a thickness that is desirably two- or three-fifths the thickness of the mattress 1 depending upon the weight of the bed-user, supports a pedestal pillow 30 within the recess 27. The pressure pad 26 is located within the body of the block 29 substantially centrally in front of the pillow 30 so as to respond to the load imposed by the user's shoulder and/or arm when sleeping on either of his/her sides.

If the load on the pad 26 exceeds a threshold previously established by adjustment of a control 31 of the unit 16, the unit 16 operates in conjunction with the hand-controller 15 to command the motor unit 8 via the cable 14 to adjust the bed to the "sleep" configuration-state A (the pre-selected configuration stored in relation to the button 19). On the other hand, if the load-threshold is not exceeded because the user is lying on his/her back, the rotor unit 8 is commanded to adjust the bed to the "sleep" configuration-state B (the pre-selected configuration stored in relation to the button 18). Accordingly, once the button 21 has been depressed to initiate the automatic "sleep" mode, the bed-configuration is adjusted automatically between the configuration-states A and B in conformity with the body-orientation adopted by the user. The system continues to a operate in this mode until such time as one or other of the buttons 18 to 20 and 23 to 25 is next depressed.

For the system to operate in an optimum manner in the automatic "sleep" mode it is desirable that the threshold value of load set using the control 31 should be related to the physical characteristics of the user when using the bed. In order to achieve this, the button 21 is first depressed to put the system into configuration B in the "sleep" mode; the bed always moves initially to configuration B (appropriate to sleep on the back) on entering this mode. While in configuration B, the user turns the control 31 to select the maximum threshold setting and then turns onto his/her side to load the pad 26. The control 31 is now turned to reduce the threshold value set, until a light-emitting diode (LED) within an indicator 32 of the unit 16, flashes. Flashing of the indicator 32 occurs when the load sensed by the pad 26 exceeds the threshold value, so the control 31 has now been appropriately set for achieving optimum action (this is confirmed by the accompanying change of the bed-configuration to state A).

Provision is made for delays in the response of the control system to changes of body orientation in order to avoid as far as possible unnecessary or premature adjustments to the bed-configuration during the automatic "sleep" mode. Both delays are implemented to retard response of the system when the load sensed by the pad 26 changes through the threshold value set by the control 31; the delay in each case is effective to ensure that the relevant change persists for a predetermined interval of time before appropriate adjustment of configuration is begun. A first of the delays, which is set by an adjustable control 33 of the unit 16, is effective to retard adjustment of the bed from configuration-state B to configuration-state A in response to increase of the sensed load through the threshold value (accompanying change of sleeping-orientation from back to side). The other delay is set by an adjustable control 34 of the unit 16 and is effective to retard adjustment from configuration-state A to configuration-state B in response to decrease of the sensed load through the threshold value (accompanying change of sleeping-orientation from side to back). This latter delay is generally set to be longer than the first since the change in the user's orientation from lying on his/her side may be only transitional in an overall change from that side to the other.

The motor unit 8 makes the adjustments of bed-configuration, especially during the automatic "sleep" mode, gently and slowly with virtually imperceptible noise so as not to disturb the bed-user. A low-voltage system is used for the purposes of safety and power to the unit 8 is switched off during periods of inactivity; more particularly, the power-supply unit 12 involves a transformer and a switch circuit that cuts off power to the cable 11 during such periods. However, while power is cut off, the electronic control system of the bed remains responsive to actuation of any of the buttons 18 to 25, under power supplied from a battery 35. As soon as there is actuation of any of the buttons 18 to 25, the switch circuit of the unit 12 is activated to restore power supply to the motor unit 8 so that the system is again fully responsive. The same re-activation takes place if during the automatic "sleep" mode there is change in load on the pad 26 justifying change of bed-configuration.

It has been found using the form of mattress 1 described above(, that the single sensor 26 located within the recess 27 is sufficient for adequate sensing of the orientation of the user of the bed while sleeping. More load sensors, of the same pressure-pad form or otherwise, could be used, and other forms of mattress might be adopted. Also, it is not necessary for the sensing of orientation to be of load, since, for example, it may be effected using a magnet attached to the user and one or more reed switches or other magnetic detectors located in or on the mattress.

What is claimed is:

1. A bed having an adjustable configuration for support of a user in varying orientations on the bed, the bed including sensing means for detecting a predetermined condition of a user's body on the bed, said predetermined condition being dependent on the orientation of the user's body on the bed, motor means operable for adjusting the configuration of the bed, and controlling means for operating said motor means to adjust the configuration of the bed, said controlling means comprising means to define first and second pre-set configurations of the bed, means responsive to detection of said predetermined condition try said sensing means for operating said motor means to adjust the configuration of the bed from said first pre-set configuration to said second pre-set configuration, and further means for operating the motor means to maintain the bed in said second pre-set condition substantially only while the sensing means continues to detect said condition.

2. A bed according to claim 1 having upper and lower sections providing support for respective upper and lower parts of the user's body, the upper and lower sections each being angularly adjustable to vary an inclination thereof, and the motor means includes means for adjusting the upper section angularly to vary the inclination thereof relative to the lower sections, and means for adjusting the lower section angularly to vary the inclination thereof relative to the upper section.

3. A bed according to claim 2 including a further section for supporting the user's body intermediate the upper and lower parts, wherein said further section links the upper and lower sections together.

4. A bed according to claim 1 wherein said further means operates the motor means to return the bed to said first pre-set configuration when said condition ceases to be detected by the sensing means.

5. A bed according to claim 1 wherein said controlling means comprises memory means for storing data defining said first and second pre-set bed configurations and means for operating the motor means in accordance with the stored data to adjust the bed between said first and second pre-set configurations according to whether the sensing means detects said condition.

6. A bed according to claim 5 wherein said controlling means operates said motor means to vary bed-configuration in accordance with selective actuation of a control device by the user, and wherein said control device is also selectively actuable by the user to enter data dependent on a selected bed-configuration into the memory means to establish that configuration as one of said pre-set bed-configurations.

7. A bed according to claim 1 whereing the controllig means comprises a load sensor for providing an output that varies in dependence upon change in load imposed thereon, jthe load sensor being positioned at a predetermined location of the bed bed at said location, and said controlling means operates the motor means in dependence upon said output of the load sensor.

8. A bed according to claim 7 wherein the motor means is operable to adjust the bed between said first and second pre-set configurations in dependence upon whether the load sensed by the load sensor exeeds a selectively-variable threshold value.

9. A bed according to claim 1 wherein the controlling means operates the motor means to adjust bed configuration in responce to detection by the sensing means of a predetermined change in orientation of the user's bosy on the bed, only if that change persists for a predetermined interval of time.

10. A bed according to claim 9 wherein the controlling means operates the motor means to adjust bed-configuration in responce to each of a plurality of predetermined changes in orientation of the user's body on the bed, such adjustment being effected in each case only if the respective change persists for a predetermined individually-adjustable interval of time.

11. A method of motorized adjustment of the configuration of a bed for support of a user using the bed, comprising the steps of utilising sensing means to detect an existence of a condition that is dependant on an oreintation of the user's body on the bed, making motorized adjustment of the bed from a first to a second of pre-set bed configurations appropriate to support of the user's body in respective orientations on the to detection of existence of said condition, and maintaining the bed in said second pre-set configuration substantially only while the sensing means continues to detect the existence of said condition.

12. A method according to claim 11 including the step of returning the bed to said first pre-set bed-configuration when said condition as detected by the sensing means ceases to exist.

13. A method according to claim 11 wherein adjustment of bed-configuration in response to change in orientation of the user's body on the bed is effected only if that change persists for a predetermined interval of time.

14. A method according to claim 11 wherein the pre-set bed-configurations are defined in accordance with pre-selection by the user for respective orientations on the bed.

15. A method according to claim 11 wherein the condition detected by the sensing means is that in which the user is lying on the bed on either of his/her sides.

16. A method according to claim 15 wherein the bed includes a mattress that has a recess for receiving a shoulder of the user when the user is lying on either of his/her sides on the bed, and the sensing means comprises a sensor located within the recess.

17. A bed having an adjustable configuration for support of a user using the bed, including sensing means for detecting a condition that is dependent on an orientation of a body of the user on the bed, motor means which is operable to adjust the bed from a first pre-set bed configuration to a second pre-set bed configuration in dependence upon a response of the sensing means for detection of said condition, and controlling means for operating the motor means to maintain the bed in said second pre-set configuration substantially only while the sensing means continues to detect said condition, wherein said sensing means comprises a load sensor for providing an output that varies in dependence upon change in load imposed thereon, the load sensor being positioned at a predetermined location of the bed to respond to a change of load resulting from a change of orientation of the user's body on the bed at said location, and said controlling means operates the motor means in dependence upon said output of the load sensor, the bed including a mattress that has a recess for receiving a shoulder of the user when the user is lying on the user's side on the bed, and the load sensor is located within the recess for responding to a condition in which the user is lying on the user's side with a shoulder in the recess.

18. A bed having an adjustable configuration for support of a user's body lying with a variable orientation on the bed, including a load sensor for providing an output that changes between a first state and a second state in accordance with the variation of orientation of the user's body on the bed, motor means which is operable to adjust the bed between a first pre-set bed configuration and a second pre-set bed configuration, and controlling means for operating the motor means in dependence upon the output of the load sensor, said controlling means operating the motor means to maintain the bed in said first pre-set configuration while said output of the load sensor has said first state and to maintain the bed in said second pre-set configuration while said output of the load sensor has said second state.

* * * * *